United States Patent [19]

Brodmann

[11] Patent Number: 4,932,108

[45] Date of Patent: Jun. 12, 1990

[54] PROCESS FOR HIGH SPEED BULKING OF GLASS FIBER STRANDS

[75] Inventor: George L. Brodmann, Winston-Salem, NC.

[73] Assignee: PPG Industries, Inc., Pittsburgh, Pa.

[21] Appl. No.: 881,497

[22] Filed: Jul. 2, 1986

Related U.S. Application Data

[63] Continuation of Ser. No. 487,373, Apr. 21, 1983, abandoned.

[51] Int. Cl.[5] ..... D02G 1/16; C03C 25/02

[52] U.S. Cl. ..... 28/271; 65/3.44

[58] Field of Search ..... 28/255, 271, 273; 65/3.44, 4.1; 156/152, 155, 166

[56] References Cited

U.S. PATENT DOCUMENTS

| | | | |
|---|---|---|---|
| 1,758,622 | 5/1930 | Rindge . | |
| 2,807,862 | 10/1957 | Griset, Jr. . | |
| 2,829,420 | 4/1958 | Griset, Jr. . | |
| 2,874,443 | 2/1959 | Griset, Jr. . | |
| 2,874,444 | 2/1959 | Griset, Jr. . | |
| 3,166,441 | 1/1965 | Rylka . | |
| 3,281,223 | 10/1966 | Simison . | |
| 3,338,777 | 8/1967 | Irwin et al. | 28/271 X |
| 3,339,357 | 9/1967 | Marzocchi et al. . | |
| 3,472,682 | 10/1969 | Rammel et al. . | |
| 3,472,717 | 10/1969 | Kim . | |
| 3,488,670 | 1/1970 | Benson . | |
| 3,605,397 | 9/1971 | Irwin et al. | 28/271 X |
| 3,664,855 | 5/1972 | Morrison et al. . | |
| 3,672,947 | 6/1972 | Luscher et al. . | |
| 3,730,137 | 5/1973 | Luscher et al. . | |
| 3,793,065 | 2/1974 | Morrison et al. . | |
| 3,829,302 | 8/1974 | Haynes et al. . | |
| 3,887,389 | 6/1975 | Hedden . | |
| 3,908,351 | 9/1975 | Carroll . | |
| 3,928,666 | 12/1975 | Morrison et al. . | |
| 3,946,132 | 3/1976 | Hedden . | |
| 3,971,871 | 7/1976 | Haynes et al. . | |
| 4,003,111 | 1/1977 | Drummond . | |
| 4,020,623 | 5/1977 | Drummond . | |
| 4,064,214 | 12/1977 | Fitzgerald | 28/271 X |
| 4,096,687 | 6/1978 | McDonald | 28/271 X |
| 4,143,006 | 3/1979 | Workman . | |
| 4,233,046 | 11/1980 | Walser . | |
| 4,296,173 | 10/1981 | Fahey . | |
| 4,307,497 | 12/1981 | Drummond | 28/271 |

FOREIGN PATENT DOCUMENTS

| | | | |
|---|---|---|---|
| 49-14427 | 4/1974 | Japan | 28/255 |
| 53-130349 | 11/1978 | Japan | 28/255 |
| 2010348 | 6/1979 | United Kingdom | 28/255 |

OTHER PUBLICATIONS

Piller, B., *Bulked Yarns*, "Air Textured Yarn Methods", Manchester, the Textile Trade Press, 1973, pp. 151–156, TS 1449, p. 530.

Robinson, J. S., *Manufacture of Yarns and Fabrics from Synthetic Fibers*, "Fluid Jet Texturing", New Jersey, Noyes Data Corporation, 1980, pp. 119–149, TS 1765 M35.

*Primary Examiner*—Werner H. Schroeder

*Attorney, Agent, or Firm*—Kenneth J. Stachel

[57] ABSTRACT

A bulking process for glass fiber strands is provided which allows for increased bulking speed while reducing any decrease in the tensile strength of the bulked glass fiber strand yarn. The process involves conveying treated glass fibers having one or more water soluble, emulsifiable or dispersible thermoplastic materials having a melting or softening point of greater than around 100° F. (37° C.), one or more cationic lubricants and water to a heater to melt or soften the thermoplastic material present on the fibers, bulking the heated glass fiber strand, removing the bulked glass fiber strand at a rate less than the rate of conveyance to bulking, and collecting the bulked glass fiber strand yarn. The treated strand being conveyed to the heater can already be dried or can be wet. After removal from bulking, the glass fiber strand can be treated with a chemical treatment to assist in retarding any additional decrease in tensile strength of the bulked glass fiber strand. The heating of the treated strand can occur before or after the strand is conveyed at a faster rate to bulking than the rate of removal from bulking. The product of the process is a bulked glass fiber strand yarn having a reduced decrease in tensile strength due to bulking.

25 Claims, 4 Drawing Sheets

PROCESS FOR HIGH SPEED BULKING OF GLASS FIBER STRANDS

This application is a continuation of application Ser. No. 487,373, filed Apr. 21, 1983 now abandoned.

The present invention is directed to a process for producing bulked glass fiber strand or strands at a high speed.

Glass fibers are produced from molten streams of glass from small orifices in a bushing of a melting furnace. These fibers are treated with a surface chemical treatment and combined in one way or another to produce glass fiber strands. For textile application, the glass fiber strands can be formed into a yarn by twisting just one strand or by twisting or by plying more than one strand together simultaneously. In addition to standard twisted and plied glass fiber strand yarn products, a demand has been growing for a product which can replace asbestos in textile uses. A good replacement product is the bulked glass fiber strand yarn.

Bulked glass fiber strand yarn can be produced in a single and/or multiple end varieties, and the bulked yarn includes such yarns as texturized yarns and slubby-type yarns. Generally, the bulked, texturized or slubby yarns consist of glass fiber strand or strands that have been subjected to considerable agitation as yarns to disturb the filaments within the strands so as to reduce the adherence between the filaments of the strands. These bulky yarns can have a linear core portion with surface, close or crunodal loops of various size and distribution depending upon the extent of the disturbance of the filaments and/or strands in the yarn. The bulked yarns may appear to have uniform areas of bulkiness or may have intermittent areas of increased bulkiness or numbers of closed loops or texturizing. The bulked yarns can be produced from basic twisted yarns and from one or more untwisted glass fiber strands. The untwisted glass fiber strand or strands processed into bulked glass fiber strand yarn can have imparted to it temporary or false twist.

An example of such a bulking process to produce bulked glass fiber strand yarn is referred as air-jet texturizing. This process involves filaments or strands being fed at a faster rate than the rate of removal from texuturizing into a rapidly moving gaseous stream, usually an air stream, at the necked region of a nozzle. Downstream from the entry of the filaments or strands into the nozzle, the channel widens, and this causes a turbulent air flow which results in loops and entanglements of the filaments in the overfeed strands and the strands themselves. After the strands are removed from the bulking device, a chemical treatment is usually applied to the bulked glass fiber strand yarn. The treated bulked glass fiber strand yarn is then collected. Examples of such bulking processes are shown in U.S. Pat. Nos. 3,672,947 and 4,003,111. Other bulking processes include edge crimping and gear crimping.

The bulked yarn product has good resistance to extension, and therefore, has found application in fabrics that require dimensional stability, considerable opacity in polymer laminates and improved surface fuzz. Generally, the bulked yarn product can be used in knitting, weaving, braiding or pleating. An example of such a bulked glass fiber strand yarn is available from PPG Industries, Inc. under the LEX® trademark for a single end bulked yarn product and under the TEXO® trademark for a multi-end bulked yarn product. Particularly, the yarns have found utility in thick fabrics, lagging fabrics, fabrics for use in electrical applications, filter fabrics, welding curtains, safety blankets, stress relieving blankets, tapes, braids, ropes, cords, wicks, bulked fillers, filtration cartridges, thermal insulation, packing, gaskets and plastic laminates.

The sized glass fiber strands that have been used in the bulking process have been those having a dried residue of a starch oil sizing composition present on the glass fibers which comprise the glass fiber strand. The sizing composition provides sufficient integrity to the fibers in the strand during forming of the glass fibers. Also, the sizing composition provides lubricity for good payout of the strands from a supply package into the bulking process. In processing these glass fiber strands in the bulking operation, the maximum speed of the strands through the bulking process has been around 600 yards per minute (1800 feet per minute). At such speeds, the exposure of the strands or yarn to the fluid turbulence of the bulking jet was sufficient to overcome to a degree the integrity of the fibers in the strand that was provided by the sizing composition. In subjecting the strands or yarn to the force of the fluid turbulence and in overcoming the integrity between the fibers, a detrimental effect occurs. The tensile strength of the bulked glass fiber strand is reduced. Some of the reduction in the tensile strength in the bulked yarn is assuaged by using an aftertreatment chemical solution on the bulked strand or yarn. The aftertreatment arrests the decrease in reduction of tensile strength and restores some of the lost tensile strength.

The bulking process with starch oil sized glass fiber strands and yarn has been attempted at speeds greater than 600 yards per minute. Because of numerous problems, this speed remains a formidable barrier to the faster processing of bulked glass fiber strands and yarn. A couple of the problems that arise in attempting to break the 600 yards per minute barrier are sloughing of the strand or yarn from the feed package and incomplete bulking of the strand or yarn in the bulking jet.

Sloughing is a condition where the strands wound in the package become loose and fall off the wound package as the strand is being fed into the texturizing process. The sloughing strands can cause snags and possibly breakage of the filaments in the strands entering the bulking process, and can actually stop the bulking process altogether.

There is a need in the art for a process to break the 600 yard per minute barrier in producing bulked glass fiber strand yarn, while reducing the apparent, concomitant disadvantages of reducing tensile strength in the bulked yarn and of sloughing of the strand or strands from the feed packages and of incomplete bulking of the strand or yarn.

It is an object of the present invention to provide a process to break the speed barrier and to produce the bulked glass fiber strand yarn at higher bulking speeds in producing bulked glass fiber strand yarn having higher tensile strengths than bulked yarn produced with a starch oil size at a speed of around 600 yards per minute.

It is a further object of the present invention to provide a bulked glass fiber strand product with higher tensile strengths than bulked strand or yarn produced with starch-oil sized strands at a speed of 600 yards per minute.

SUMMARY OF THE INVENTION

The foregoing objects and additional objects gleaned from the following disclosure are achieved by the process and product of the present invention.

In its broadest aspects, the process of the present invention involves conveying treated glass fibers from one or more supply packages; heating the treated glass fibers; bulking the heated, treated glass fibers and collecting the bulked glass fibers. The treated glass fibers conveyed to bulking after heating are those that had been treated with an aqueous treating composition having an aqueous soluble, emulsifiable or dispersible thermoplastic material and a cationic lubricant and water, wherein the water is in an amount to give a total solids for the composition ranging from about 0.1 to 20 weight percent. In addition, the aqueous treating composition can have a film forming material which forms a film either by evaporation of a carrier like water or through reaction. The treated glass fibers are prepared into one or more strands by any conventional method. One or more strands of the treated glass fibers present on a supply package, which may be either in a wet or dry condition, is conveyed from the supply package to a heating zone. In the heating zone the strand or strands are heated at a temperature to melt the thermoplastic material present on the glass fibers to make the glass fiber strand or strands more susceptible to bulking. The bulking occurs by texturizing with fluid pressure in a nozzle having a necked region. In such a nozzle, the strand or strands move with a rapidly moving fluid, usually air, where the strand is fed into the nozzle at a faster rate than it is removed from the nozzle. The relative rates can be varied along with the fluid or air pressure of the nozzle to produce varying degrees of bulkiness of the yarn. Downstream from the entry of the filaments or strands into the nozzle the channel widens, which results in a turbulent fluid flow that causes loops and entanglements of the filaments and strands. Other bulking processes such as edge crimping and gear crimping can also be used although the industry prefers the use of fluid nozzles such as air jets because they are less damaging to the strands. Once the strand or strands are bulked, they are removed and collected.

In addition, the bulked strand or strands that are removed from the bulking device can be treated with a chemical treatment, which assists in arresting any damage to the bulked strand or strands in further processing. The chemical treatment can be applied as an aqueous solution by passing the bulked strands through the aqueous solution or spraying the aqueous solution onto the bulked strands or any other method known to those skilled in the art. The aqueous chemical treating composition can be any conventional starch, gelatin, resin-base composition or other coating material such as flowable materials of polymeric composition, either thermoplastic or thermosetting, and flowable hot melt materials.

The process for bulking the glass fiber strand, strands or yarn hereinafter referred to as strand, can be performed at speeds in excess of 600 yards per minute (1800 feet per minute) and upwards of speeds around 1,000 yards per minute (3,000 feet per minute).

The product from this process can be a single end or multi-end bulked glass fiber strand depending on whether one or a plurality of strands are bulked simultaneously. The bulked strand product has less of a reduction in tensile strength than bulked strand produced from bulking processes utilizing strands treated with a starch-oil treating composition and bulked by air texturizing at speeds of around 600 yards per minute. Also, the bulked glass fiber strand has good bulking characteristics.

DETAILED DESCRIPTION AND PREFERRED EMBODIMENT OF THE INVENTION

Figure 1:
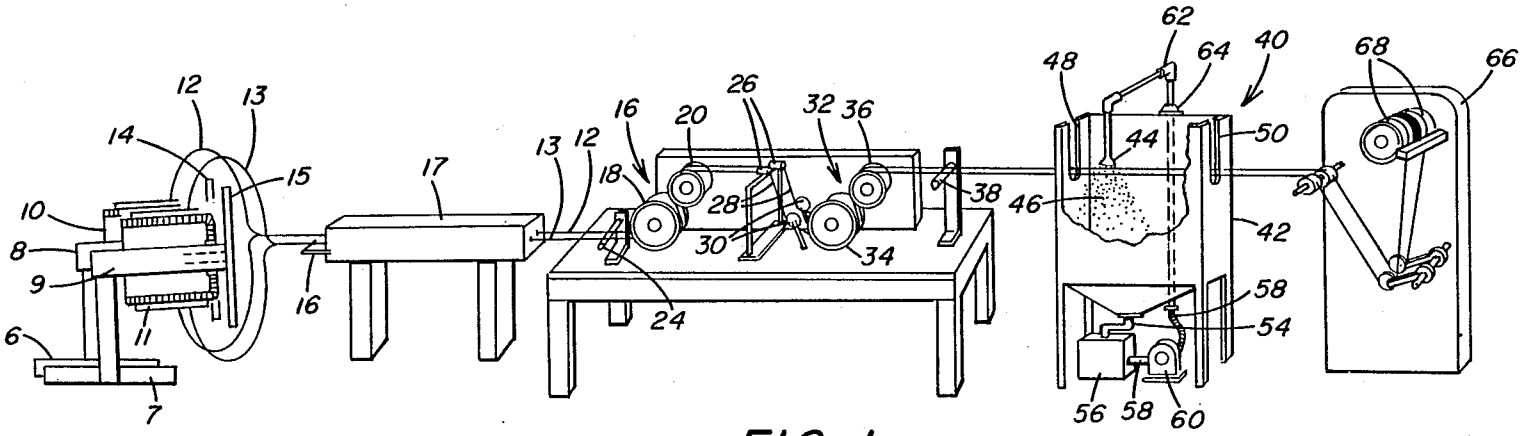
FIG. 1 is a schematic representation illustrating the process for heating, bulking and chemical treatment of the strand within the contemplation of this invention, wherein forming packages are used as the supply packages for the strands and the heating occurs before the feed rolls to the bulking jet.

The treated glass fiber strand conveyed to the bulking process of the present invention must have sufficient integrity between the filaments within the strand to allow for good payout of the strand from the supply package. Also, the treated glass fiber strand must be susceptible to bulking so that not too high of a bulking force is required to achieve the desired degree of bulking. Bulking of the strand reduces the tensile strength of the bulked glass fiber strand, since the bulking force, usually air pressure, is disturbing the filaments within the strand and in some cases, breaking the filaments. The overspray treatment assists in arresting further deterioration of the tehsile strength of the bulked glass fiber strand.

The treated glass fiber strand having a coating or residue of an aqueous treating composition must have sufficient integrity, but must also have susceptibility to bulking to produce bulked glass fiber strand. The present conventional aqueous treating composition on glass fibers used in a bulking process is a starch-oil type sizing composition. With this sizing composition, the integrity of the fibers within the strand is sufficient for good payout of the strand from a supply package and the strand can be bulked at speeds of 600 yards per minute (1800 feet per minute). When speeds higher than 600 yards per minute are attempted, the bulking character of the glass fiber strand is reduced, since the exposure of the strand to the bulking force is reduced because of the increased speed. If the bulking force, i.e. air pressure, is increased to achieve the desired bulking characteristics because of the reduced exposure of the strand to the bulking force, the bulked strand will have a greater reduction of tensile strength because of increased filament breakage. In such a high speed bulking process, increasing the bulking force is the only countermeasure available to the decreased exposure of the strand to the bulking force.

By using the treated glass fibers in the process of the present invention, wherein the fibers have on at least a portion of their surface a thermoplastic material with a melting point of at least around 100° F. (37° C.) and a cationic lubricant. The strands have the integrity sufficient for good payout from the supply package. In addition, the process of the present invention involves the synergistic cooperation of the thermoplastic material on the fibers and the heating prior to bulking. It is believed, without limiting the scope of the present invention, that the heating reduces the integrity of the fibers within the strand at the point in the process where the integrity is providing the resistance to the bulking force. With the reduced integrity, the strand is passed to the bulking force and the bulking force need not overcome as great a resistance, as if, the integrity of the fibers within the strand was the same as it was before heating. But, integrity of the bulked glass fiber strand is also required. So after the strand is bulked, the strand is cooled so that the thermoplastic material resolidifies, thereby, providing sufficient integrity for further processing. The beneficial results of this synergistic cooperation is that the speed of the bulking process can be increased above 600 yards per minute, even as high as 1,000 yards per minute (3,000 feet per minute), while achieving the adequate bulking characteristic but without incurring increased reductions in tensile strength of the bulked glass fiber strand.

The treated glass fiber strand for use in the bulking process of the present invention can be produced by any conventional method of drawing glass fibers from small orifices in a bushing of a glass melting furnace. The batch composition used in forming the glass fibers can be any conventional glass batch composition such as, "E-glass" or "621 glass" or any more environmentally acceptable derivative thereof, or any other fiberizable glass batch composition known to those skilled in the art. The fibers are drawn and attenuated by a winder and as they are attenuated the fibers are drawn across an applicator which may be, for example, a belt applicator, a roller applicator or the like for supplying a chemical treating composition to the fibers. The fibers are then gathered usually by a gathering shoe mechanism into one or more unitary glass fiber strands. The glass fiber strands may be drawn at speeds of from around 2,500 to greater than 18,000 feet per minute or more (762 to 5,486 meters per minute or more). The strand passes across a spindle and is wound on the winder into a forming package on the mandrel of the winder. Either the spindle or the winder may traverse to form a layered package of the glass fiber strand or strands. Such a process is illustrated in U.S. Pat. No. 3,999,970 (Barch et al.) at FIG. 1, which is hereby incorporated by reference. Also, any other method known to those skilled in the art for forming glass fibers, treating glass fibers with an aqueous chemical composition, and gathering the glass fibers into one or more strands, and collecting the strands into a forming package or into a roving package can be used.

The aqueous treating composition of the present invention used to treat the glass fibers, when they are formed, is comprised of at least one or more water soluble, emulsifiable or dispersible thermoplastic materials, one or more cationic lubricants and water.

The thermoplastic material has a melting point or softening point of at least around 100° F. (37° C.). This thermoplastic material will not lose its nonflowable state due to any heat of friction, while the strand traverses pulleys and other mechanical contact points. Several nonexclusive examples of the thermoplastic material useful in the present invention include any water soluble, miscible, emulsifiable or dispersible: wax; saturated polyester polymers including copolymers; ethylene vinyl chloride copolymers; acrylonitrile-butadiene-styrene acetals homopolymers and copolymers; polyacrylates; polymethylmethacrylate; methylmethacrylate styrene copolymer; ethyl cellulose; cellulose acetate; cellulose acetate propionate; cellulose acetate butyrate; polychlorotrifluoroethylene; polytetrafluoroethylene; polyamides; polyvinylacetate; polybutylene terephthalate; polyethylene terephthalate; polyether sulfone; polyolefins such as polyethylene and polypropylene, and polyethylene polypropylene copolymers; polystyrene; polysulfones; urethane elastomers; copolymers of styrene and butadiene; copolymers of styrene and ethylene, and butylene; polyvinyl chloride; and polyvinyl chloride-acetate, polyvinylidene chloride; polyvinyl formal; chlorinated polyvinyl chloride; polyethylene oxide homopolymer; polyethylene-polypropylene oxide copolymers; polyalkylene polyols; polyoxyalkylene polyols and the like that have a melting or softening point of at least around 100° F. With thermoplastic or slightly thermosetting materials which would tend to deposit a brittle or discontinuous film, a plasticizer can be used. For example, a plasticizer may be used with polyvinylacetate, polyvinylchloride and polyacrylates and polystyrene. The plasticizer may be any known plasticizer for various polymers such as dibutyl phthalate, tricresyl phosphate, dioctyl phthalate, diisooctyl phthalate and other esters which are conventionally used as plasticizers. The plasticizer can be used in a conventional amount to render the polymeric material more flowable. Additional nonexclusive examples of thermoplastic materials such as waxes that can be used include: vegetable waxes such as carnauba, Japan bayberry, candelilla, and the like; animal waxes such as beeswax, Chinese wax, hydrogenated sperm oil wax, and the like; mineral waxes such as ozocerite montan, ceresin and the like; and synthetic waxes such as polyalkylenes like polyethylenes, polyethylene glycols, polyethylene esters, chloronapthalenes, sorbitals, polychlorotrifluoroethylenes; petroleum waxes such as paraffin, microcrystalline waxes and the like, where these waxes have a melting point of at least around 100° F. (37° C.).

The thermoplastic material has a dual function in that it acts as an external or dry lubricant for the glass fibers allowing the glass fibers to endure the abrasion caused by the subsequent processing steps such as winding and gathering, twisting and bulking, without breaking the glass fibers. Also, the thermoplastic material functions to melt or soften, when heated to decrease the integrity of the strands. The amount of the thermoplastic material in the aqueous treating composition of the invention is generally in the range of about 0.1 to 20 and preferably about 0.1 to about 10 weight percent of the aqueous treating composition.

Any thermoplastic material that is insoluble or immisible in water to any degree must be added to the aqueous treating composition as an emulsion or dispersion. It is preferred that the thermoplastic material is a wax that is emulsifiable in water, like a paraffin wax. The preferred paraffin wax is a paraffin wax having a melting point from around 120°-127° F. (50°-53° C.). The emulsifier system used in emulsifying the thermoplastic material for addition to the aqueous treating composition of the present invention is important because an acceptable stability of the treating composition must be achieved. The aqueous emulsion can be made with any one or more nonionic, anionic or cationic emulsifiers known by those skilled in the art to be useful in forming an aqueous emulsion of a thermoplastic material. A particularly useful emulsifying system for a water insoluble wax is a dual emulsifying system. One emulsifier is a sorbitan monostearate and the other emulsifier is a polyoxyethylene sorbitan monostearate, wherein one emulsifier has an HLB as low as about 4.5 and the other emulsifier has an HLB as high as about 15. The amounts of the two emulsifiers used in the aqueous treating composition are those amounts to give an HLB for the emulsifying system between about 8 to about 12. The preferred emulsifiers for the preferred wax used in the aqueous sizing composition of the present invention has been found to be the sorbitan monostearate available as "AHCO 909" with an HLB of 4.7 and "AHCO-DFS-149" a polyoxyethylene (20) sorbitan monostearate with an HLB of 14.9. Both of these products are commercially available from ICI America Inc. The amount of the emulsifiers used in the treating composition should be at least about 0.1 part per part of wax. Although it is preferred that the emulsifier system is comprised of the two emulsifiers as those mentioned above, it is within the scope of the present invention to have an emulsifier system with more than two emulsifiers as long as the emulsifier system has an HLB in the range of about 8 to about 12 and preferably in the range of about 8 to about 10.5.

The HLB is an expression of the relative simultaneous attraction of an emulsifier for water and oil or for the two phases of the oil-in-water emulsion system being considered. It would appear to be determined by the chemical composition and extent of ionization of a given emulsifier.

In addition to the thermoplastic material, the aqueous treating composition also has present a cationic lubricant or textile softener to provide a softening action to the treated glass fibers. Typical cationic lubricants or softeners are alkyl imidazoline derivatives such as those described in U.S. Pat. Nos. 2,200,815; 2,267,965; 2,268,273; 2,355,837; which are hereby incorporated by reference. The material designated "Cation-X®" is an example of such a material, wherein the alkyl imidazoline derivative is the reaction product of the stearic acid, tetraethylene pentamine and acetic acid. Acid solubilized, water dispersible, stearic amides and anhydrous acid and the solubilized, water dispersible low molecular weight fatty acid amides as well as anhydrous acid, solubilized Polyunsaturated low molecular weight fatty acid amides can also be used as the cationic lubricant. The amount of the cationic lubricants used in the aqueous treating composition of the present invention is in the range of about 0.10 to about 0.30 weight percent of the aqueous treating composition and on a nonaqueous basis, the amount of the cationic lubricant is in the range of about 3 to about 14 or more weight percent and specifically, from about 4 to about 8 weight percent.

Additional ingredients that can be used in the aqueous treating composition are those known by those skilled in the art for use in aqueous treating compositions for glass fibers, where these ingredients are not very sensitive to changes in humidity conditions and temperature conditions. Several examples of such agents include: wetting agents like IGEPAL 630 polyethylene glycol and additional dry lubricants. Also, additional film forming polymers that form films by evaporation of a carrier like water or by reaction can be used, but their use or their amount in the aqueous composition should be limited. Too large an amount of these materials may increase the integrity of the strand, and hence the resistance to bulking.

When the strands are to be bulked from bobbins having twisted strands, a starch type film forming material may be present in the aqueous treating composition to provide increased protection for the fibers during twisting. The starch component can be any water soluble starch such as dextrin, and any water insoluble starch, such as amylose, and the starch can be from the commercially available starches such as those derived from corn, potato, wheat, sago, tapioca and arrow root, and these may be modified by crosslinking. The crosslinking modification may be carried out by any conventional method known to those skilled in the art. The starch can contain any percentage of amylose starch and any percentage of amylopectin starch that are known to those skilled in the art. The starch may be a low amylose starch, which is a water repellant starch that contains from 25 to 27 percent amylose with the remaining being amylopectin starch. The low amylose starch contains cross-links and is preferably a lightly cross-linked corn starch. Also, considered to be included for the purpose of this invention are starch mixtures containing a low amylose component and a high amylose component that are lightly crossbonded to each other to provide a weak knit. Examples of such a starch mixture are given in U.S. Pat. No. 3,227,192 hereby incorporated by reference. The preferred starch is a high amylose potato starch which is cross-linked with epichlorohydrin and available from National Starch under the trade designation National 1554. This preferred starch is characterized by unusually high film strength and flexibility and has a Brabender viscosity of 9.5 percent solids (dry). It has a gel temperature minimum of 67° C. (with a peak of 400 Brabender units) and a gel temperature maximum of 73° C. and a peak of 700 Brabender units.

The cross-linked starch can be prepared for the aqueous sizing composition by cooking or partial cooking or gelatinization by any conventional method. An example includes mixing the starch with water in a main mix tank with good agitation, and heating the mixture while agitating to achieve the desired degree of cooking or gelatinization, and cooling the mixture with the addition of water. An example of a mix tank that can be used is the jet cooker available from National Starch, although any other type of starch cooker may be used. In the present invention, it should be noted that the term cooking is intended to note particle breakdown with attendant conversion of the material to the form of a solution. It is preferred to partially cook and crosslink the starch by adding the starch to water and heating the mixture in a jet cooker at a temperature in the range of about 220° F. (104° C.) to about 250° F. (121° C.) at a pressure in the range of about 40 psi to about 45 psi.

Any temperature and pressure equivalent to these temperatures and pressures can be used. The amount of the crosslinked partially cooked starch present in the treating composition would be in the range of about 50 to about 70 weight percent based on the nonaqueous components of the composition. Based on the aqueous components of the composition, the amount is in the range of about 1.7 to about 2.3 weight percent. The preferred starch mixture that can be used is about 40 percent water insoluble after cooking.

When the starch is present as a film forming material, the aqueous treating composition of the present invention would also have a small amount of fungicide and/or bactericide to deter the growth of fungi and/or bacteria in the treating composition due to the presence of the starch. Any fungicide or bactericide known to those skilled in the art may be used, such as, one of the organo-metallic quaternary type fungicides such as tributyltinoxide. The fungicide or bactericide is usually employed in sufficient amounts to prevent mold attack or growth on the amylose containing starch derivative. Suitable effective amounts of the fungicide are those equivalent to about 3 milliliters for every 5 gallons of the aqueous treating composition. The amount of fungicide can be varied depending on the amount of the starch used in the aqueous treating composition to function effectively as a mold and fungi suppressant.

The aqueous treating composition of the present invention can be prepared by any method known to those skilled in the art for preparing stable aqueous treating compositions for glass fibers. If the thermoplastic material must be emulsified, the methods of emulsification to form an oil-in-water emulsion can be any method known to those skilled in the art utilizing nonionic, cationic or anionic emulsifiers that closely match the HLB of the thermoplastic material. The aqueous treating composition is applied to the glass fibers during their formation by any method known to those skilled in the art, where steps are taken to maintain the emulsion in emulsified form. One such step is to have a heated composition in order to maintain the emulsified form, particularly for solid materials, during the process of applying the composition to the glass fibers.

In FIG. 1 there is shown a process where the feed supply packages are forming packages 10 and 11, which feed supply strands or yarns 12 and 13 respectively. The forming packages 10 and 11 are supported on supports 8 and 9, respectively, which are mounted on stands 6 and 7, respectively, which are supported by a base or the floor. Round plates 14 and 15 having central pins, which are received on the interior of support 8 and 9, are provided in a spaced relationship from the packages 10 and 11. The diameter of the plates exceed that of the packages and during operation of the process forces the strands removed from the packages to balloon out over it, thus preventing the strands from snagging or sloughing off the packages 10 and 11. The strands 12 and 13 are passed through a pair of guide eyes 16 after removal from the packages 10 and 11 and passed into heater 17. The heater can be typically a resistance heater or any other heater known to those skilled in the art for treating textile material. The heater is supplied with suitable energy from a power source through electric leads (not shown). For a heater of about 3 to about 5 feet in length, temperatures of about 425° C. to about 650° C. are typically maintained in this heating zone for strand speeds of around 1,800 to around 3,000 feet per minute. These conditions provide an exposure time of the strand to the heat of around 0.5 second to adequately remove moisture from the wet strand having about 9 percent moisture thereon and to melt the thermoplastic material present on the glass fibers. The conditions of length of the heater, temperature and strand speed can be varied to supply any equivalent exposure time to adequately heat the strands for reduction of moisture and for melting the thermoplastic material. If the forming packages have been dried previously to reduce the moisture content of the strand, the temperature of the heater or other conditions can be reduced. For instance, if the strand had been dried to a moisture content of less than 0.5 percent by weight, the temperature of the heater can be reduced to be that greater than the softening point or melting point of the thermoplastic material on the glass fibers, since the heater does not have to dry the strand but only melt the thermoplastic materials. The melting of the thermoplastic materials reduces the integrity of the strand when it leaves the heater. The heated strands 12 and 13 are removed from the heater and are passed over the surface of a dry roll 18 coupled for rotation to a suitable drive source (not shown) and subsequently over nip roller 20, journaled for rotation with its outer cylindrical surface in frictional contact with the outer cylindrical surface of a roll 18. Rolls 18 and 20 are heated rollers such as those known in the art and preferably with nonsticking surfaces so that the heated strands coming from heater 17 do not lose too much of the heat obtained from the heater as they pass over these rollers. Suitable rollers would be rollers having a Teflon® polyfluorocarbon surface that are capable of being heated internally by hot oil or the like to a temperature similar to the temperature of the heater 17.

As is shown, strands 12 and 13 upon being withdrawn from the heater 17 traverse a tensioning device 24 then follow an "S" shape path around and between rolls 18 and 20. The strands are introduced into a bulking or preferably a texturizing jet or nozzle 26, one for each strand which may be of any desired construction, such as those disclosed in U.S. Pat. Nos. 2,783,609; 3,328,863; 3,381,346.

Different types of texturizing nozzles may be used with this invention depending upon the end product desired. Regarding single end texturizing, fine tolerance adjustments of jet air flow and/or air flow direction are helpful in producing a good bulked or texturized yarn. Also, in view of the high speed of strand travel, through the texturizing nozzles, precision alignment of the feed and take up rolls is preferred. The air supply system to the bulked jets 26 utilized in practicing the instant invention are those conventionally used in the art. Air pressures on the order of about 10 to about 80 pounds per square inch gauge are normally employed to provide bulking to the strand. Although reduced air pressures of around 10 to 60 psig or lower are possible because of the reduced strand integrity. The fluids utilized in the bulking jet in the process depicted in FIG. 1 are typically gases such as air, nitrogen, oxygen, carbon dioxide and other similar gases. In the preferred embodiment of the invention, air is utilized as the gas source. For multiend texturized strands, several strands are fed to one texturizing jet.

Upon leaving the texturizing nozzles 26, strands 12 and 13 are then directed downwardly and forwardly at an angle between an upper guide 28, located adjacent nozzles 26 and lower guides 30, located adjacent an underside of a take-up roll assembly 32. Strands 12 and 13 then pass in an "S" shaped path around and between the drive roll 34 and the nip or idler roll 36 that comprises take-up roll assembly 32. The strands are thereafter directed by guide 38 in a horizontally disposed path to binder applicator 40. Drive rolls 38 and 34 are driven at identical rates of speed. However, while the outer diameters of idler rolls 20 and 36 are the same, the outer diameter of drive roll 18 is larger than the outer diameter of drive roll 34. As is well understood by those skilled in the art, this difference in diameters determines the percentage of overfeed of strands 12 and 13 necessary to accomplish texturizing of the strands 12 and 13 by the texturizing nozzles 26. The percentage of overfeed can also be controlled or alternatively controlled by using identical drive rolls and identical idler rolls for feed and take-up, but where the speed of the drive rolls are regulated individually.

As shown, binder applicator 40 comprises an upwardly open tank or reservoir 42 and a vertically adjustable spray nozzle 44 that directs a pressurized spray of binder 46 downwardly across the path of strands 12 and 13 and into tank 42. Tank 42 has its opposite sidewalls that intersect the path of yarn travel and slots 48 and 50 permit traverse of the yarns 12 and 13 through applicator 40, while keeping the binder spray 46 within the confines of the applicator. The bottom of tank 42 is equipped with an outlet 52 through which excess binder spray 46 can be directed or returned through a tube 54 to binder reservoir 56. By means of tubes 58 and pump 60, binder withdrawn from binder reservoir 56 is pressurized to a predetermined amount and directed or fed to spray nozzle 44 through connecting piping 62. Piping 62 is supported by a c}amp 64 fixed to tank 42 so that nozzle 44 can be vertically adjusted to the desired height perpendicular to strands 12 and 13. Any other method of applying a chemical aftertreatment solution to the strands can be used; such as, passing the strands through a bath of the chemical treatment, or spraying the chemical treatment by any other means by one more than one spray device located at different locations than spray device 44. For example, the spray devices can be located diagonal to each other, coming from the corners of reservoir 42. The chemical treatment used for the spray can be of any desired liquid composition and any desired consistency or viscosity. For example, starch, oils, resins, hot melt or solvent type materials in liquid form, including emulsions, suspensions and the like can be used. An example of one suitable chemical treatment is that disclosed in U.S. Pat. 4,371,584 (Fahey) hereby incorporated by reference. Additional details of the binder spray device are given in U.S. Pat. No. 3,370,137 (Luscher) hereby incorporated by reference.

With the treated glass fiber strand being fed to the process of the present invention, it is not always necessary, although it is preferable, to have the chemical aftertreatment sprayed on the bulked or texturized glass fiber strand yarn. It is possible to bulk the glass fiber strand yarn and then collect the bulked glass fiber strand yarn without a chemical treatment. If the bulked or texturized glass fiber strand yarn is not to be treated with a chemical aftertreatment or after the chemical aftertreatment is applied, the strands 12 and 13 are directed to a suitable winder or take-up device 66, where the texturized or texturized and chemically coated or impregnated strands 12 and 13 are wound into a strand package 68.

Figure 2:
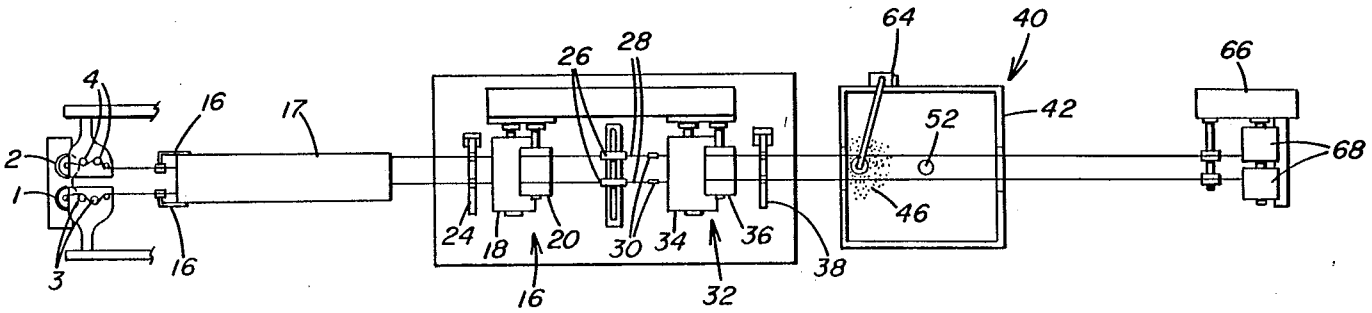
FIG. 2 is a plan view representing the process for heating, bulking and chemical treatment of the strand within the contemplation of this invention, wherein the yarn is twisted yarn supplied from bobbins and the heating occurs before the feed rolls for the bulking jets.

FIG. 2 shows the plan view of FIG. 1, where the strand fed to the process is from a bobbin which has twisted strand. In this case, the strands have already been dried prior to twisting and/or have been air dried during twisting and the temperature of heater 17 can be reduced. As is shown in FIG. 2, the strands are withdrawn from bobbins 1 and 2 and the strands pass through tensioning device 3 and 4, respectively, before entering guide eyes 16 and heater 17. The ]est of the description for FIG. 1 is applicable to FIG. 2 with the elements having the same numbers for FIG. 1 and FIG. 2 representing the same elements performing the same function.

Figure 3:
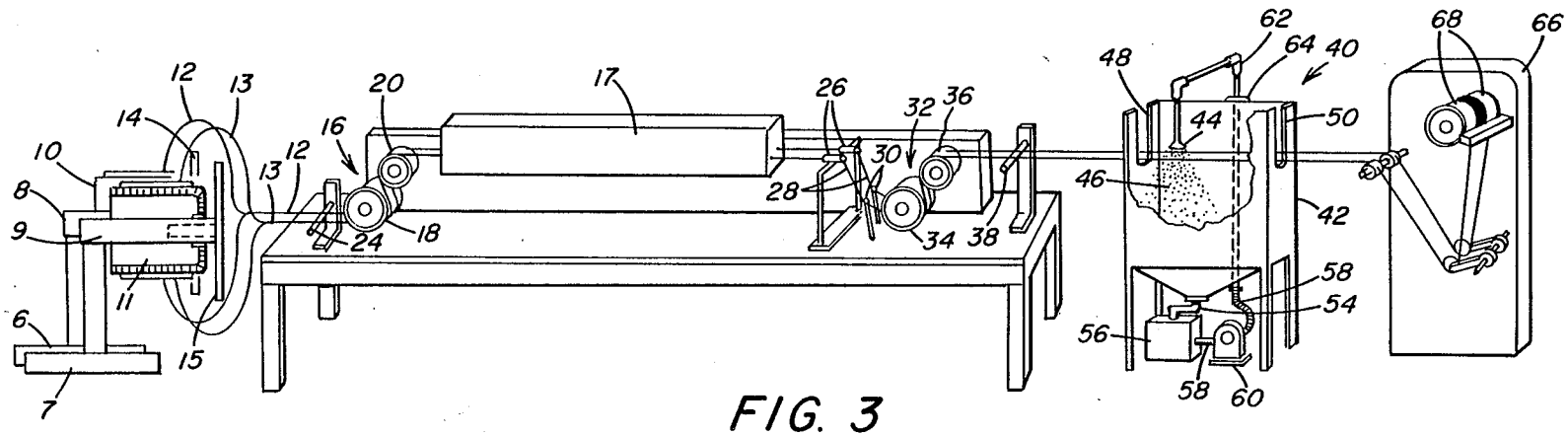
FIG. 3 is a schematic representation illustrating the apparatus for heating, bulking and chemical treatment of the strand within the contemplation of this invention, wherein the heating occurs after the feed rolls for conveying the strands to the bulking jets and where the strand is supplied from forming packages.
Figure 4:
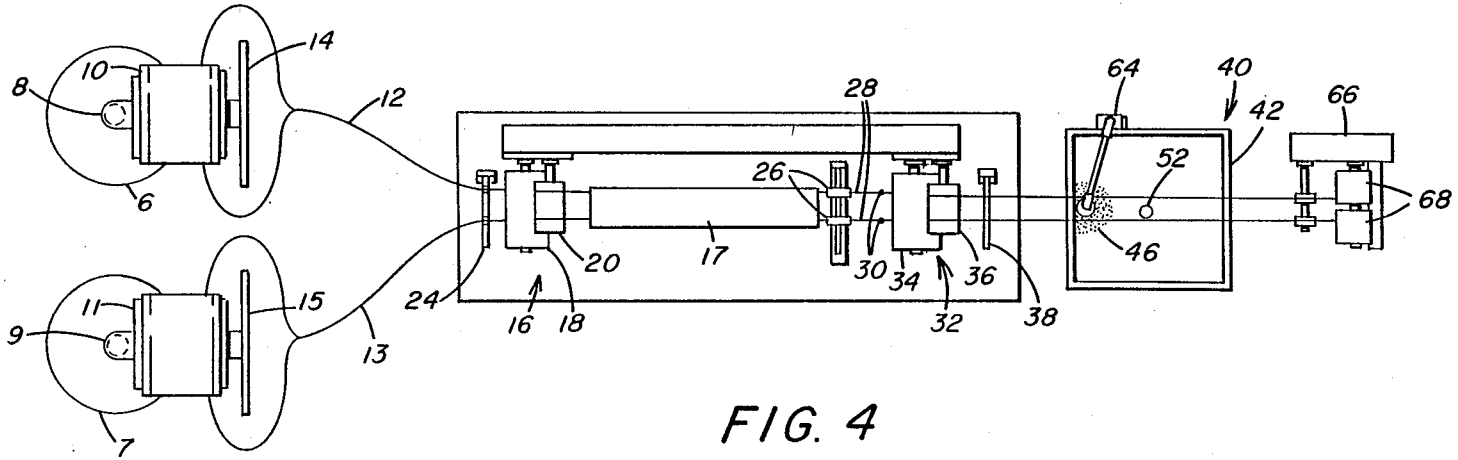
FIG. 4 is a plan view of the process illustrated in FIG. 3.

FIGS. 3 and 4 show a representation of the present invention where heater 17 is located after drive roll and nip rollers 18 and 20, respectively. In this representation the strands from forming packages 10 and 11, i.e., strands 12 and 13 respectively, traverse the strand tensioning device 24 and enter the drive roll and nip roller assembly 16. In this representation, the drive roll and nip roller 18 and 20 need not be heated rollers with a nonsticking exterior surface, but can be any drive and nip rollers known to those skilled in the art. In this representation, heater 17 is operated in a similar manner to the operation of heater 17 in FIG. 1 with or without guide eyes 16. After the strand is heated, and leaves the heater 17, it is bulked or texturized in a similar manner as described in FIG. 1. The elements represented by similar numbers or FIGS. 1 and 3 are similar elements performing :he same function.

Figure 5:
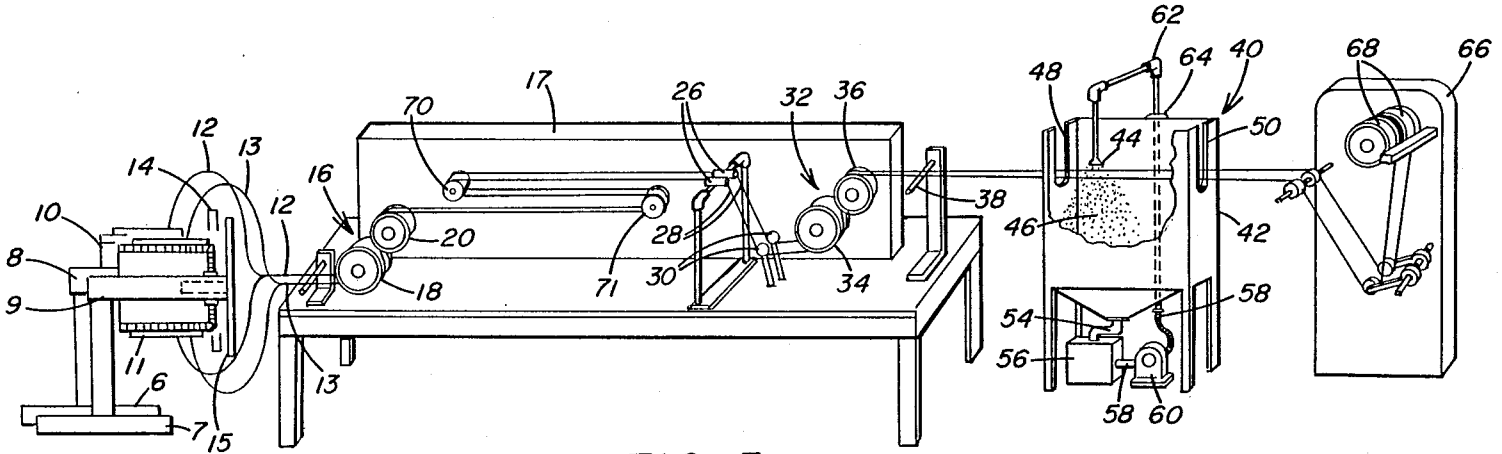
FIG. 5 is a schematic representation illustrating the process of FIG. 3, wherein the heater allows for multiple passes of the strand.

FIG. 5 is a representation o¼the process of the present invention, where the heater located after the drive roll 18 and nip roller 20 allows for several passes of the strand through the heater. In this representation, the heater could have a lower temperature, because the exposure time of the strand in the heater is longer due to the multiple passes made by the strands. Here, the multiple passes are permitted by rollers 70 and 71 over which the strand travels and reverses direction to travel in the opposite direction from the direction it first entered the heater 17. The description of the other elements and their function for FIG. 5 is similar to the description of the elements for FIGS. 3 and 4.

Figure 6:
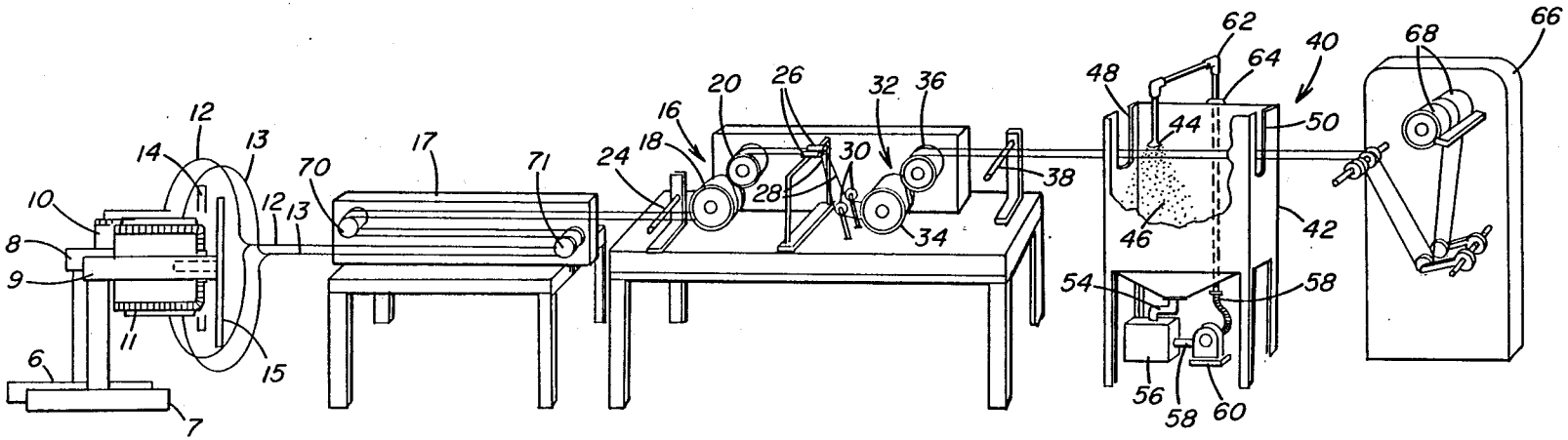
FIG. 6 is a schematic representation illustrating the process of the present invention, wherein the heater allows for multiple passes of the strands before the strands are conveyed to the feed rollers that convey the strand to the bulking jets.

FIG. 6 is a representation o the process, where the heater 17 allowing for multiple passes of the strands is located before nip rollers 18 and 20. The description of the elements and their function in this representation of the invention is similar to the description for FIG. 1 except for the multiple passes of the strand through the heater which is similar to that described in FIG. 5.

In the preferred embodiment of the present invention, the forming package is a wet forming package for single end texturizing and the heater is located after drive roller and nip roller 18 and 20, respectively. The strand preferably has an LOI (loss on ignition) of the aqueous treating composition in the range of around 0.45 to around 0.75 weight percent, although, generally, the LOI can be in the range of about 0.1 to about 2 weight percent. The upper amounts in the range will require higher air pressures for bulking. The heater is preferably about 3 to about 4 feet long and operated at a temperature in the range of about 900° F. to about 1100° F. (482° C.–593° C.). The strand is passed through the heater at a speed in the range of about 700 to 1,000 yards per minute.

The heated strand is immediately texturized at around 40 to around 65 psig with a jet nozzle having a venturi of around 0.056 to around 0.082 and a needle of around 0.040 to around 0.052 where the strand speed is around 900 yards/minute.

After texturizing, an overspray is preferably placed on the texturized strand and the texturized strand (yarn) is handled in a manner similar to that described in U.S. Pat. No. 4,371,584, hereby incorporated by reference.

Figure 7:
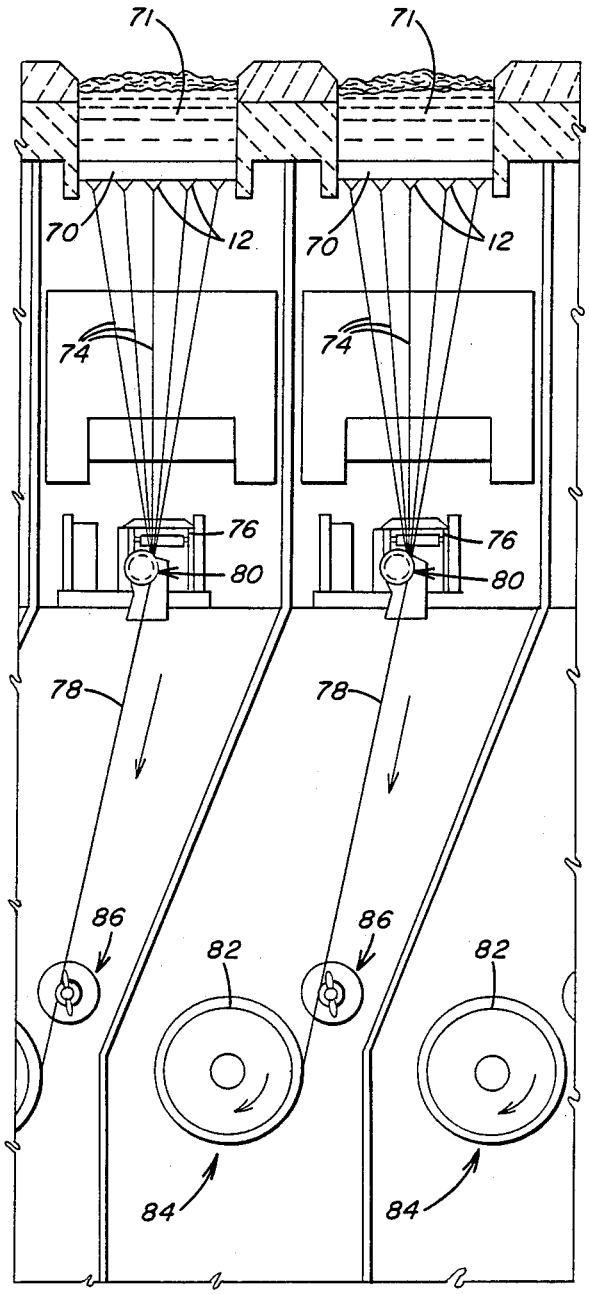
FIG. 7 diagrammatically illustrates the formation of winding of a forming package of glass strand where the forming package can be used as the feed in FIGS. 1 and 3–6.

FIG. 7 shows molten glass 71 contained in a bushing 70 having orifices in bushing tips 72. Glass fibers 74 are attenuated through the orifices. These fibers 74 are drawn across an applicator 76, where they are coated with the aqueous chemical treating composition. The fibers 74 pass from the applicator 76 and are gathered into one or more strands 78 by a gathering shoe 80. The one or more strands 78 are wound as a forming package 84 on the winder 82 by spiral 86.

The invention is further illustrated by the following examples.

EXAMPLE 1

Glass fibers treated with the following formulation were gathered into strands to form G-37 glass fiber strand on forming packages. The forming packages were texturized in an air texturizing process as described in the preferred embodiment.

| Ingredient | Gms in 20 Gals. (75.71 liters) of $H_2O$ |
|---|---|
| National 1554 (potato starch 50/50) | 1600 |
| Paraffin wax | 800 |
| AHCO-909 Emulsifier (sorbitan fatty acid ester stearate) | 50 |
| AHCO-DFS-100 Emulsifier (polyoxyethylene sorbitan fatty acid ester stearate) | 50 |
| Cation-X: (alkylimidazoline-reaction product of tetraethylene pentamine and stearic acid) [wet lubricant] | 144 |
| Biomet 66 Biocide | 1.4 |
| Viscosity at 140° F. cps | 7.5 |
| Solids percent | 3.4 |
| pH | 6 |

For examples 2, 3, 4, and 5, the sizing formulations could be used to treat any glass fibers to be produced into strand for feeding to the bulking process of the present invention.

EXAMPLE 2

EXAMPLE 2

| Ingredient | Gms in 20 Gals. (75.71 liters) of $H_2O$ |
|---|---|
| Nonionic polyethylene oxide homopolymer 100,000 molecular wt. (Polyol WSRN-10 polymer) | 800 gm. |
| Polyalkylene polyol (Pluracol ® V-10 polyol) | 200 gm. |
| Cationic lubricant (Cation-X lubricant) | 150 gm. |

EXAMPLE 3

EXAMPLE 3

| Ingredient | Gms in 20 Gals. (75.71 liters) of $H_2O$ |
|---|---|
| Polyoxyalkylene polyol (Pluracol ® V-7 Polyol) | 500 gm. |
| Polyalkylene polyol (Pluracol ® V-10 polyol) | 500 gm. |
| Cationic lubricant (Cation-X | 150 gm. |

EXAMPLE 3-continued

| Ingredient | Gms in 20 Gals. (75.71 liters) of $H_2O$ |
|---|---|
| lubricant) | |

EXAMPLE 4

EXAMPLE 4

| Ingredient | Gms in 20 Gals. (75.71 liters) of $H_2O$ |
|---|---|
| Polyoxyalkylene polyol (Pluracol ® V-7 polyol) | 200 |
| Polypropylene/polyethylene 50/50 polymer (Abraize Aid material) | 800 gm. |
| Cationic lubricant (Cation-X lubricant) | 150 gm. |

EXAMPLE 5

EXAMPLE 5

| Ingredient | Gms in 20 Gals. (75.71 liters) of $H_2O$ |
|---|---|
| Polypropylene/polyethylene 50/50 polymer (Abraize Aid aterial) | 800 gm. |
| Cationic lubricant (Cation-X lubricant) | 150 gm. |

The foregoing has described a process and a product of the process for bulking glass fiber strands to obtain high bulking speeds and to reduce the decrease in tensile strength due to bulking. The process involves heating a glass fiber strand having a thermoplastic material present on the fibers to the melting point or softening point of the thermoplastic material and then bulking the heated glass fiber strand.

I claim:

1. A process for preparing texturized strands of glass fibers, comprising:
   a. conveying at least one treated strand of glass fibers from at least one supply package, where the glass fibers have a coating of an aqueous treating composition present on at least a portion of their surfaces to give the strand of glass fiber sufficient integrity between the fibers to permit good payout from the supply package, wherein the aqueous treating composition has:
      1. at least one heat flowable polymeric material selected from the group consisting of water soluble, dispersible, and emulsifiable heat flowable polymeric materials having at least a softening point of at least around 100° F. (37° C.),
      2. cationic lubricant, and
      3. water in an amount to give a total solids for the treating composition in the range of about 0.1 to about 20 weight percent,
   b. heating at least one strand conveyed from at least one supply package to a temperature of at least the softening point of the heat flowable polymeric material present on the fibers in the strand to reduce the integrity of the fibers in the strand to increase the susceptibility of the strand to texturizing,
   c. feeding the heated strand to texturizing at a first rate of speed,
   d. texturizing the heated strand by fluid texturizing in a texturizing jet nozzle, e. removing the texturized strand from the jet nozzle at a rate slower than the rate of feeding to the jet nozzle, f. cooling texturized glass fiber strand to resolidify the heat flowable polymeric material to provide integrity to the strand, and g. collecting the texturized glass fiber strand.

2. Process of claim 1, wherein the supply package is at least one forming package.

3. Process of claim 1, wherein the texturizing is performed by air jet texturizing with air pressures in the range of about 10 to about 80 psig.

4. Process of claim 1, wherein the heat flowable polymeric material is a thermoplastic material in an oil-in-water emulsion with at least one emulsifier selected from the group consisting of: nonionic, cationic or anionic emulsifiers having an HLB to match the HLB of the thermoplastic material.

5. Process of claim 4, wherein the heat flowable polymeric material is selected from the group consisting of plasticized thermoplastic and thermosetting polymers.

6. Process of claim 5, wherein the heat flowable polymeric material is a thermoplastic material which is wax in an oil-in-water emulsion with at least one nonionic emulsifier having an HLB in the range of about 8 to about 12 for the emulsion.

7. Process of claim 1, wherein a film former is present in the aqueous treating composition.

8. Process of claim 7, wherein the film forming material is starch and the strand has been twisted and is supplied for texturizing from at least one bobbin.

9. Process of claim 1, wherein the texturized glass fiber strand is removed from the texturizing jet by takeup rolls conveying the bulked yarn to a collecting winder.

10. Process of claim 9, wherein the strand is conveyed by feed rolls before heating and the feed rolls are operated to allow a faster rate of feed to the texturizing jet nozzle than conveying from the texturizing jet nozzle to collecting.

11. Fluid texturized glass fiber strand having improved tensile strength produced according to claim 1.

12. Process of claim 1, wherein the strand is heated to a temperature of at least the melting point of the heat flowable polymeric material which has a melting point of at least around 100° F. (37° C.).

13. process of claim 1, wherein the conveying, heating, texturizing, and collecting is conducted at a speed of above 600 yards per minute.

14. A process for preparing texturized strands of glass fibers, comprising:

a. conveying at least one treated strand of glass fibers from at least one supply package, where the glass fibers have a coating of an aqueous treating composition present on at least a portion of their surfaces to give the strand of glass fiber sufficient integrity between the fibers to permit good payout from the supply package, wherein the aqueous treating composition has:

1. at least one heat flowable polymeric material selected from the group consisting of water soluble, dispersible, and emulsifiable heat flowable polymeric materials having at least a softening point of at least around 100° F. (37° C.),
2. cationic lubricant, and
3. water in an amount to give a total solids for the treating composition in the range of about 0.1 to about 20 weight percent, b. heating at least one strand conveyed from at least one supply package to a temperature of at least the softening point of the heat flowable polymeric material present on the fibers in the strand to reduce the integrity of the fibers in the strand to increase the susceptibility of the strand to texturizing, c. feeding the heated strand to texturizing at a first rate of speed by heated feed rolls having exterior surfaces of polytetrafluorocarbon, d. texturizing the heated strand by fluid texturizing in a texturizing jet nozzle, e. removing the texturized strand from the jet nozzle at a rate slower than the rate of feeding to the jet nozzle by take-up rolls that convey the texturized yarn to be collected, f. cooling texturized glass fiber strand to resolidify the heat flowable polymeric material to provide integrity to the strand, and g. collecting the texturized glass fiber strand.

15. Process of 14, wherein the texturized glass fiber strand is conveyed to a chemical aftertreatment zone before the strand is collected.

16. Process of claim 15, wherein the strand is conveyed by feed rolls before heating and the feed rolls are operated to allow a faster rate of feed to texturizing than the rate of removal from texturizing and conveyance to the chemical aftertreatment zone before the strand is collected.

17. Process for preparing a fluid texturized strand of glass fibers, comprising:

a. conveying the treated glass fiber strand from at least one supply package, where the glass fibers have a coating of an aqueous treating composition present on at least a portion of their surfaces to give the strand of glass fibers sufficient integrity between the fibers to permit good payout from the supply package, wherein the aqueous treating composition has:

1. a starch film former,
2. heat flowable polymeric materials selected from the group consisting of water soluble, dispersible, and emulsifiable heat flowable polymeric materials having at least a softening point of at least around 100° F. (37° C.),
3. cationic lubricant, and
4. water in an amount to give a total solids for the treating composition in the range of about 0.1 to about 20 weight percent, b. heating the strand conveyed from the supply package to a temperature of at least the softening point of the thermoplastic material present on the fibers in the strand to increase the susceptibility of the strand to texturizing, c. feeding the heated strand to fluid texturizing through heated feed rolls having a nonsticking external surface, d. fluid texturizing at least one heated glass fiber strand, e. removing the strand from texturizing at a rate slower than the rate of feed to texturizing, whereby the strands cool and the heat flowable polymeric material resolidifies to provide integrity to the strand, f. treating the texturized glass fiber strands with a chemical treatment, g. collecting the treated texturized glass fiber strand.

18. Process of claim 17, wherein a wax emulsion is the heat flowable polymeric material, and the wax has a melting point of around 50° to 53° C.

19. Process of claim 17, wherein the strand is heated to increase the susceptibility of the strand to texturizing by the heated rollers while being fed to texturizing.

20. Process for preparing a texturized strand of glass fibers of claim 17, wherein the strand is heated to a temperature of at least the melting point of the heat flowable polymeric material which has a melting point of at least around 100° F. (37° C.).

21. Process of claim 17, wherein the conveying, heating, texturizing and collecting are conducted at a speed of above 600 yards per minute.

22. Process of claim 17, wherein the treated glass fiber strand is conveyed from at least one supply package produced by:

a. drawing glass fibers from molten glass through a plurality of orifices in a bushing,
b. treating the fibers during forming with an aqueous treating composition having heat flowable polymeric material having at least a softening point of at least around 100° F. (37° C.), cationic lubricant, and water in an amount to give a total solids for the treating composition in the range of about 0.1 to about 20 weight percent,
c. gathering the fibers into at least one strand, and
d. collecting the strand of glass fibers into at least one package.

23. Process of claim 22, wherein the strand is wet and the heating of the strand is conducted at a temperature of about 425° C. to about 650° C. at a strand speed of 1,800 to about 3,000 feet per minute through a 3 to 5 foot heater whereby the strand is exposed to heat for around 0.5 seconds for adequate removal of moisture from the wet strand having about 9 percent moisture and to melt the heat flowable polymeric material.

24. Process of claim 17, wherein the strand is wet and the heating of the strand is conducted at a temperature of about 425° C. to about 650° C. at a strand speed of 1,800 to about 3,000 feet per minute through a 3 to 5 foot heater, whereby the strand is exposed to the heat for around 0.5 seconds for adequate removal of moisture from the wet strand having about 9 percent moisture and to melt the heat flowable polymeric material.

25. A process for preparing texturized strands of glass fibers, comprising:

a. conveying at least one treated strand of glass fibers from at least one supply package, where the glass fibers have a coating of an aqueous treating composition present on at least a portion of their surfaces to give the strand of glass fiber sufficient integrity between the fibers to permit good payout from the supply package, wherein the aqueous treating composition has:
   1. at least one heat flowable polymeric material selected from the group consisting of water soluble, dispersible, and emulsifiable heat flowable polymeric materials having at least a softening point of at least around 100° F. (37° C.),
   2. cationic lubricant, and
   3. water in an amount to give a total solids for the treating composition in the range of about 0.1 to about 20 weight percent,
b. heating at least one wet strand conveyed from at least one supply package to a temperature of about 425° C. to about 650° C. at a strand speed of 1,800 to about 3,000 feet per minute through a 3 to 5 foot heater, whereby the strand is exposed to heat for around 0.5 seconds for adequate removal of moisture from the wet strand having about 9 percent moisture and to melt the heat flowable polymeric material present on the fibers in the strand to reduce the integrity of the fibers in the strand to increase the susceptibility of the strand to texturizing,
c. feeding the heated strand to texturizing at a first rate of speed,
d. texturizing the heated strand by fluid texturizing in a texturizing jet nozzle,
e. removing the texturized strand from the jet nozzle at a rate slower than the rate of feeding to the jet nozzle,
f. cooling texturized glass fiber strand to resolidify the heat flowable polymeric material to provide integrity to the strand, and
g. collecting the texturized glass fiber strand.

* * * * *